US011270676B2

(12) United States Patent
Savona

(10) Patent No.: US 11,270,676 B2
(45) Date of Patent: Mar. 8, 2022

(54) BASS CAJON AND PORTABLE DRUM KIT SYSTEM INCORPORATING SAME

(71) Applicant: Richard M. Savona, Newark, DE (US)

(72) Inventor: Richard M. Savona, Newark, DE (US)

( * ) Notice: Subject to any disclaimer, the term of this patent is extended or adjusted under 35 U.S.C. 154(b) by 251 days.

(21) Appl. No.: 16/586,959

(22) Filed: Sep. 28, 2019

(65) Prior Publication Data

US 2020/0105233 A1 Apr. 2, 2020

Related U.S. Application Data

(60) Provisional application No. 62/738,321, filed on Sep. 28, 2018, provisional application No. 62/854,589, filed on May 30, 2019.

(51) Int. Cl.

| | |
|---|---|
| ***G10D 13/02*** | (2020.01) |
| ***G10D 13/06*** | (2020.01) |
| ***G10D 13/11*** | (2020.01) |
| ***G10D 13/18*** | (2020.01) |
| ***G10D 13/10*** | (2020.01) |

(52) U.S. Cl.

CPC ..... *G10D 13/02* (2013.01); *G10D 13/06* (2013.01); *G10D 13/11* (2020.02); *G10D 13/18* (2020.02); *G10D 13/28* (2020.02)

(58) Field of Classification Search

CPC ..... G10D 13/02; G10D 13/28; G10D 13/18; G10D 13/11; G10D 13/06

USPC ..... 84/412

See application file for complete search history.

(56) References Cited

U.S. PATENT DOCUMENTS

| | | | | |
|---|---|---|---|---|
| 2,893,283 | A | 7/1959 | Ippolito | |
| 3,326,074 | A * | 6/1967 | Osty | G10D 13/03 84/411 R |
| 3,326,084 | A | 6/1967 | Osty et al. | |
| 3,433,115 | A | 3/1969 | Kjelstrom | |
| 4,593,596 | A | 6/1986 | Gauger | |
| 6,211,448 | B1 | 4/2001 | Shigenaga et al. | |
| 7,608,769 | B2 * | 10/2009 | Izen | G10D 13/02 84/411 R |
| 7,928,302 | B2 | 4/2011 | Sandson | |
| 9,406,286 | B1 * | 8/2016 | Simonek | G10D 13/02 |
| 9,449,588 | B2 | 9/2016 | Verderosa | |

(Continued)

FOREIGN PATENT DOCUMENTS

WO 20140189369 A1 11/2014

*Primary Examiner* — Jianchun Qin

(74) *Attorney, Agent, or Firm* — Invention To Patent Services; Alex Hobson

(57) ABSTRACT

A portable drum kit system is configured to be converted from a transport configuration to a drumming configuration. The drum kit system includes a cajon with a plurality of other drum components and a convertible storage container that converts to a seat when in a drumming configuration. The portable drum kit system is easy to transport in one trip, as all the components are coupled to, configured in or on, the convertible storage container that has a set of wheels and a handle. The portable drum kit eliminates the need for expensive and bulky drum covers, cymbal cases typically required for transportation of these components. The drum kit may include a snare drum, tom tom, hi-hat, cymbal and a tambourine. The cajon may be configured to produce only bass frequencies and may include high and mid tone sound absorbing material within the cajon.

9 Claims, 14 Drawing Sheets

(56) References Cited

U.S. PATENT DOCUMENTS

| | | | | |
|---|---|---|---|---|
| 9,691,366 | B2 * | 6/2017 | Amos | G10D 13/28 |
| 9,792,887 | B2 * | 10/2017 | Pinelli | G10D 13/00 |
| 9,972,293 | B1 | 5/2018 | Keller | |
| 10,013,960 | B1 * | 7/2018 | Wish | G10D 13/11 |
| 10,783,861 | B2 * | 9/2020 | Fowler | G10D 13/02 |

* cited by examiner

BASS CAJON AND PORTABLE DRUM KIT SYSTEM INCORPORATING SAME

CROSS REFERENCE TO RELATED APPLICATIONS

This application claims the benefit of priority to U.S. provisional patent No. 62/738,321 filed on Sep. 28, 2018, and to U.S. provisional patent No. 62/854,589 filed on May 30, 2019; the entirety of both applications are hereby incorporated by reference herein.

BACKGROUND OF THE INVENTION

Field of the Invention

The invention relates to a bass cajon and a portable drum kit system that is convertible from a transport configuration to a drumming configuration.

Background

A conventional drum set has a large number of components including a snare drum, one or more tom toms, cymbal, hi-hat, bass drum, a tambourine, a seat and the like. Traditionally, each of these components comprises a separate transport container which requires multiple trips to set up the drum set. Packing and unpacking a drum kit and setting it up can take a lot of time. A cajon is a bass drum that is typically used while sitting on the cajon and beating on the face to create a bass sound. A traditional cajon produces bass and mid-range sounds such as sound having a frequency of 200 Hz or more, or 250 Hz or more, or 300 Hz or more. A cajon produces sound and when a drummer beats on the cajon with their hands, it prevents them from utilizing other drum components. There exists a need for a portable drum set that is easy to set up, can be packaged in a compact container for transport and provides enough drum components to provide authentic drumming sounds and authentic drumming experience.

SUMMARY OF THE INVENTION

The invention is directed to a portable drum kit system comprising a bass cajon and a method of converting said drum kit system from a transport configuration to a drumming configuration. An exemplary drum kit system comprises a cajon with a plurality of attachments for attachment of some of the drum components and a convertible storage container that converts to a seat when in a drumming configuration. An exemplary cajon is a bass cajon that produces sound frequencies of 300 Hz or less and preferably 250 Hz or less and even more preferably 200 Hz or less. The exemplary portable drum kit system is easy to transport in one trip, as all the components are coupled to, configured in or on, the convertible storage container that has a set of wheels and a handle. The top of the convertible storage container may be used as a seat when the kit is configured in a drumming configuration and the lid of the convertible storage container may have a cushion for comfort. The cushion may be configured inward or toward the inside of the convertible storage container during transport and then flipped over when in a drumming configuration.

An exemplary portable drum kit system may comprise a plurality of drum components including, but not limited to, a snare drum, one or more tom toms, cymbal, hi-hat, bass drum such as a cajon, a tambourine and the like. A portion of these drum components may be configured inside of the convertible storage container and some may be retained to the exterior of the convertible storage container. In an exemplary embodiment, a portable drum kit system comprises a snare drum, tom tom, cymbal, hi-hat, cajon and a tambourine. In an exemplary embodiment, the snare drum, tom tom, cymbal and tambourine are attached to the cajon when in a drumming configuration and are stored inside of the convertible storage container when in a transport configuration. The hi-hat cymbals may be configured inside of the convertible storage container and the hi-hat stand may be retained in a sleeve or other retainer coupled to the convertible storage container during transport. Also, the hi-hat stand may be stored for transportation in the cajon and may extend up through a top sound opening in the cajon.

Drum components may be detachably attached to the cajon by attachments such as elongated rods that are configured to accept a clamp to attach the drum component. The elongated rod attachments may be bolted to the top of the cajon and may have threads or a rough exterior to further ensure a secure attachment of the drum component. In an exemplary embodiment, an attachment is a threaded bolt that is secured to the cajon, such as to the top wall, by bolts; one on the outside and one on the inside surface of the cajon wall. The bolts may be removed quickly and easily and stored in the convertible storage container. In another embodiment, an attachment comprises a receiver having an opening for the insertion of a drum component stand or attachment bracket. The receiver may be clamped closed or tighten down around the attachment bracket, such as a rod, of the drum component. The top of the polished bolt may be the shape of a tightscrew drum tension rod so that the drummer can do a quick turn, such as a ⅛ turn with a drumkey and lock the bolt in place so that it does not loosen as a result of vibrations. The bolt may be detached with a counter turn with a drumkey.

An exemplary portable drum kit system comprises a cajon pedal that is detachably attachable to the cajon, such as to the back wall of the cajon. A cajon pedal bracket may be secured to the cajon for attachment of the cajon pedal. This enables a drummer to use their foot to create a bass drum sound with the cajon and frees their hands to play the other drum components, like with a traditional drum set. An exemplary cajon pedal bracket has a cajon portion and a pedal portion that may be connected by a hinge to enable the bracket to be folded closed during transport. A magnet may be configured to secure the pedal portion against the cajon portion during transport.

An exemplary convertible storage container of a portable drum kit system comprises to top opening for receiving the drum components. The lid may be removed to expose the top opening and the lid may comprise a cushion that is faces inward during transport. The cushion may comprise a resilient deformable material, such as a foam or fabric, that secures the drum components in place and protects them during transport. An exemplary convertible storage container comprises a lower portion and an upper portion that is separated from the lower portion by a divider. An exemplary divider may be on a hinge or may be detachably attachable and sit on rails along the inside surface of the convertible storage container. A user of the system may load drum components in the lower portion and then configure the divider over the lower portion, such as by closing the divider by the hinge or inserting it onto the rails, and then insert additional drum components in the upper portion. An exemplary convertible storage container may comprise apertures in the divider and/or in the base to receive elongated members of the drum components, such as stands which typically comprise rods. A divider aperture may align with an aperture in the base or lid to secure an elongated member drum component, or stand component in place during transport. An exemplary convertible storage container may comprise one or more sleeves for retaining drum components such as stands or pedals, for example. In an exemplary embodiment a hi-hat stand is retained in a sleeve that is attached to the convertible storage container and the hi-hat cymbals are retained inside of the convertible storage container. Alternatively, the hi-hat stand is retained in the cajon and may extend out of a top sound opening. The cajon may be configured to rest on the top surface of the convertible storage container when in a transport configuration. A strap may be used to secure the cajon to the convertible storage container and may extend around the handle and/or under the convertible storage container.

In an exemplary embodiment, a cajon has a detachably attachable panel, such as the bottom panel, that is removed to enable the cajon to slid down over the convertible storage container in a transport configuration. In addition, a cajon may only have five sides and no bottom panel, as it may be placed on a flat surface to form the enclosure while in a drumming configuration. In still another embodiment, the cajon without a bottom panel or with a detachably attachable panel is the convertible storage container and a separate seat may be used while in a drumming configuration. A separate seat may be coupled to the convertible storage container or may be a separate item from the exemplary portable drum kit system.

An exemplary convertible storage container comprises a pair of wheels that are configured to engage with the ground when the convertible storage container is tilted. A user may use a handle, such as a retractable handle, coupled to the convertible storage container and tilt the convertible storage container to engage the wheels with the ground and transport the portable drum kit by rolling the entire kit on the wheel. The wheels may extend from the back or side of the convertible storage container.

An exemplary portable drum kit system can be converted from a transport configuration to a drumming configuration comprising by removing the plurality of drum components from the convertible storage container and attaching the plurality of drum components to the plurality of attachments on the cajon. In an exemplary embodiment the lid of the convertible storage container has a seat side that faces into the convertible storage container when in a transport configuration and faces outward when in a drumming configuration. In an exemplary embodiment, the method further comprises flipping over the lid of the convertible storage container to configure the seat facing up. In an exemplary embodiment, the method of converting the portable drum kit comprises the step of attaching the cajon pedal to the cajon pedal bracket on the cajon.

An exemplary cajon of a portable drum kit system may have a sound opening on the front of the cajon and/or on the top of the cajon. A sound opening cover may be placed over one of the sound openings according to a drummer's preference. A top sound opening emits sound from the top and enables the drummer to more effectively hear the sound produced by the cajon, which is important to drummers. A sound opening may be configured with a sonic enhancement port that amplifies and channels the bass frequencies. An exemplary sonic enhancement port is a "KickPort" available from KickPort as described in U.S. Pat. No. 7,582,820, to Millender, Jr, et al; the entirety of which is hereby incorporated by reference herein. Another exemplary sonic enhancement port is available from D'Addario and described in U.S. Pat. No. 7,074,992, to Schmidt; the entirety of which Is hereby incorporated by reference herein.

In an exemplary embodiment, the front of the cajon is configured with a polymer panel that is translucent to allow light to pass through the polymer panel. A sound opening may be configured in the polymer panel and a sonic enhancement port may be configured in the sound opening. An exemplary polymer panel may be polycarbonate, polyester, polyethylene, Poly(methyl methacrylate) (PMMA), also known as acrylic, and the like. The polymer panel vibrates and produces a bass sound and may produce more sound than a conventional wood panel that extends along the front of the cajon. A sound opening, and in some embodiment a sonic enhancement port, may be configured in the bottom half of the cajon, offset from a center location along the height. The center point of the sound opening or sonic enhancement port may be below the center point of the height, or center height axis, or preferably, the entire sound opening or sonic enhancement port is configured below the center height axis, or in the bottom half of the cajon. This lower location may produce a deeper bass sound.

A polymer panel may be secured to the cajon by a plurality of fasteners and these fasteners may have fastener gaps, or distance between the fasteners to allow sound and air to exit between the polymer panel and the cajon. An exemplary fastener gap may be about 10 cm or more, about 12 cm or more, about 15 cm or more, about 20 cm or less, about 25 cm or less and any range between and including the fastener gaps provided. If the fastener gap is too small, air and sound may not be able to effectively escape between the fasteners and if the fastener gap is too larger, the polymer panel may not be held in enough tension to produce sound effectively. An exemplary polymer panel may have a thickness of about 4 mm or more, about 6 mm or more, about 8 mm or more, about 12 mm or more about 20 mm or more and any range between and including the thickness values provided. If the polymer panel is too thick and/or stiff, it may not vibrate enough to produce a desired bass sound from the cajon.

An exemplary cajon may have a batter panel configured along the back side of the cajon. A batter coupled to a cajon pedal may be manipulated by a drummer's foot to impact the batter on the back of the cajon or on the batter panel. The batter panel may be made out of wood, such as a sheet of wood or wood laminate and may have a thickness and stiffness to allow an effective amount of vibration to produce the vibrations in the interior of the cajon. A batter panel may have a thickness of about 4 mm or more, about 6 mm or more, about 8 mm or more, about 12 mm or more about 20 mm or more and any range between and including the thickness values provided. If the batter panel is too thick and/or stiff, it may not vibrate enough to produce a desired bass sound from the cajon.

An exemplary cajon has a batter panel configured along the back of the cajon and has a spacer gap produced by the spacers configured between the batter panel and the body of the cajon. This spacer gap allows the batter panel to vibrate when impacted by the batter. This additional vibration produces a richer and deeper bass sound. The spacers have a thickness of about 1 mm or more, about 2 mm or more, about 3 mm or more, about 4 mm or more, about 12 mm or less, about 2 mm to 8 mm and any other range between and including the thickness values listed. The spacers may be configured around the batter fasteners, or may be retained by a separate fastener. The batter fasteners may have a batter fastener gap distance, or distance between the fasteners, of about 10 cm or more, about 12 cm, about 15 cm or more, about 20 cm or less, about 25 cm or less and any range between and including the fastener gaps provided. If the fastener gap is too small, air and sound may not be able to effectively escape between the fasteners and if the fastener gap is too larger, the polymer panel may not be held in enough tension to produce sound effectively.

An exemplary cajon may be a bass cajon and produce lower bass frequencies, wherein the average sound frequency is 300 Hz or less, preferably 250 Hz or less and more preferably 200 Hz or less. In some embodiments, the average sound frequency is no more than 150 Hz. Put another way, a substantial portion of the sound produced by the cajon may be bass frequencies, wherein at least 90% of the sound produces has a frequency of 300 Hz or less, preferably 250 Hz or less and more preferably 200 Hz or less, and even more preferably 150 Hz or less. In an exemplary embodiment, the sound frequency is measured using a Spectrum Analyzer App, available on the App store. See http/SpectrumAnalyzerApp.com, for more details. The version available as of Sep. 28, 2019, or an equivalent, may be used to determine sound frequencies produced by a cajon.

An exemplary bass cajon may have sound absorbing material configured along inside surfaces of the cajon, such as along the top, bottom, sides, and back surfaces. The sound absorbing material may be configured to absorb mid-range and high frequency sounds, such as sound having a frequency of 200 Hz or more, or 250 Hz or more, or 300 Hz or more. The sound absorbing material may be porous and have a surface area and structure to absorb these sounds frequencies, and may be a textile, such as carpet or other fiber or yarn containing material, foam or honeycomb material. An exemplary sound absorbing material may be an open cell foam having a cell structure to capture and retain mid and high range sound frequencies.

An exemplary cajon may be made out of wood, such as maple or birch wood as they produce an effective sound. An exemplary cajon may be a rectangular box having a height of about, 30 cm or more about 40 cm or more, about 50 cm or more or about 75 cm or less and any range between and including the values provided.

The summary of the invention is provided as a general introduction to some of the embodiments of the invention, and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
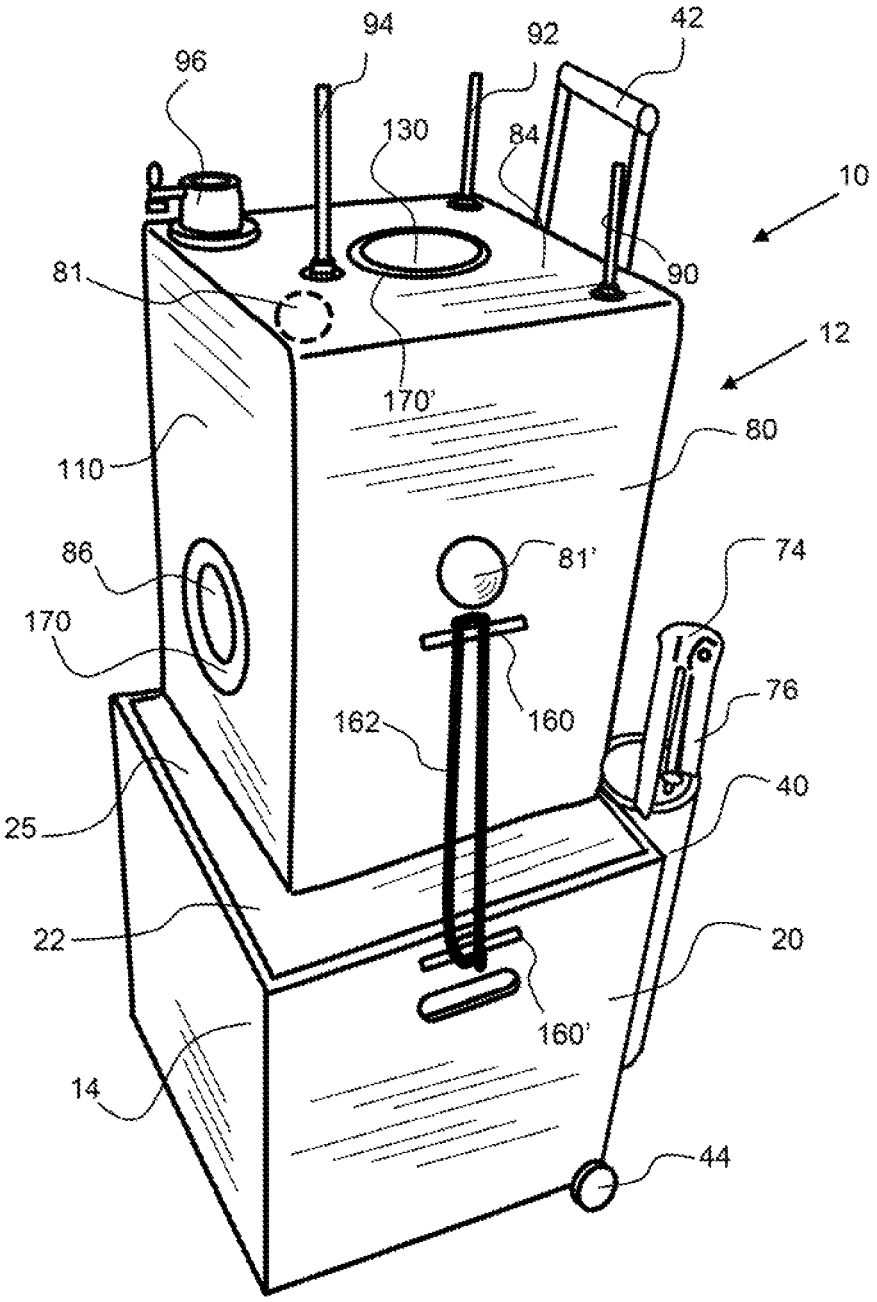
FIG. 1 shows an exemplary portable drum kit system in a transport configuration comprising a convertible storage container having wheels and a handle and a cajon with a plurality of drum component attached configured on top of the convertible storage container.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises." "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

Definitions

A cajon is a box-shaped percussion instrument that produces a bass drum sound from a sound outlet opening that is typically circular in shape and located on one of the sides, such as the front side. A cajon is typically played by sitting on the cajon and beating or slapping one of the side panels with your hands or hands. An exemplary cajon is a rectangular box having planar sides including a front, back, two opposing sides, top and bottom and is typically made of wood panels. A cajon may have a detachable bottom panel and the cajon may be configured to slide down over the convertible storage container during transport. The cajon may be pull up off of the convertible storage container and the bottom panel may then be attached. It may be possible to use a cajon without a bottom panel as well.

A tom-tom drum is a cylindrical percussion instrument, a drum with no snares. Tom-toms range in size between 6 and 20 inches (15 and 51 cm) in diameter, though floor toms can go as large as 24 inches (61 cm).

A snare drum or side drum is a percussion instrument that produces a sharp staccato sound when the head is struck with a drum stick. A snare drum has a series of stiff wires that are held under tension against the lower skin. A snare drum is a central piece in a drum set. Snare drums are usually played with drum sticks, but other beaters such as the brush, thunderrods and the like can be used to achieve very different sounds.

A hi-hat comprises two cymbals and a foot-operated pedal that moves a rod coupled with one of the cymbals. Hi-hats are typically included in a standard drum set or kit. A hi-hat has a pair of mating cymbals, small to medium-sized cymbals, mounted on a stand, with the two cymbals facing each other. The bottom cymbal is fixed and the top is mounted on a rod which moves the top cymbal towards the bottom one when a foot pedal is depressed (a hi-hat that is in this position is said to be "closed" or "closed hi-hats").

A crash cymbal is a type of cymbal that produces a loud, sharp "crash". They can be mounted on a stand and played with a drum stick, or by hand in pairs. One or two crash cymbals are a standard part of a drum kit or set. An exemplary crash cymbal may range in thickness from paper-thin to very heavy, but have a fairly thin edge. An exemplary crash cymbal is typically 14 to 18 inches (36 to 46 cm) in diameter, but sizes down to 8 inches (20 cm) and up to 24 inches (61 cm) are manufactured.

The ride cymbal is a standard cymbal in most drum kits or sets and is typically used to produce a steady rhythmic pattern, sometimes called a ride pattern.

A splash cymbal is typically the smallest accent symbol in a drum kit or set. Splash cymbals and china cymbals are the main types of effects cymbals. An exemplary splash cymbal has a diameter from 6 inches to about 13 inches but may be as small as 4 inches in diameter.

A China-type cymbals are a distinct type of crash cymbals that produces a bright, crisp, and explosive tone. A China-cymbal is frequently mounted upside down on cymbal stands, allowing for them to be more easily struck and for a better sound.

A cymbal, as used herein, may be any of the cymbals as defined above.

A Tambourine is a percussion musical instrument having a frame, often of wood or plastic and a plurality of pairs of small metal jingles, called "zills". A tambourine is typically configured on an arced shaped frame and can be played by hand or by striking the frame with a drum stick or another implement.

As shown in FIG. 1, an exemplary portable drum kit system 10 is configured in a transport configuration with a cajon 80 configured on top 22 of the convertible storage container 20. The portable drum kit 12 is easily transported from one location to another and comprise a convertible storage container that retains a plurality of drum components 14 therein. The convertible storage container has wheels 44 and a handle 42 that enable the portable drum kit to be rolled from one place to another. A user may tilt the convertible storage container with the handle 42 to engage the wheels. The cajon has a plurality of attachments on the top for attachment of drum components. A hi-hat stand 74 and hi-hat pedal 76 are configured in a sleeve 40 coupled to the convertible storage container 20. There are a number of attachments on the top of the cajon 80 including, a snare drum attachment 90, a tambourine attachment 92, a tom tom attachment 94 and a cymbal attachment 96. As shown in FIG. 1, the cajon may comprise one or more lights 81, 81' that are configured to illuminate and may illuminate or change intensity with the beat of the cajon. An exemplary light 81' may be configured on the outside of the cajon, such as along the front wall, one or both side walls, on the top wall or inside of the cajon, such as light 81. A top sound opening 130 is configured in the top 84 of the and may enable the drummer to hear the bass sound produced by the cajon 80. A cajon may have a front wall sound opening 86 and/or a top sound opening 130. As shown in FIG. 1, cleats 160 and 160' provide support for a strap 162 to secure the cajon 80 to the convertible storage container 20. The convertible storage container 20 may comprise a handle 120, which may extend out from the convertible storage container or be an aperture in the convertible storage container.

Figure 2:
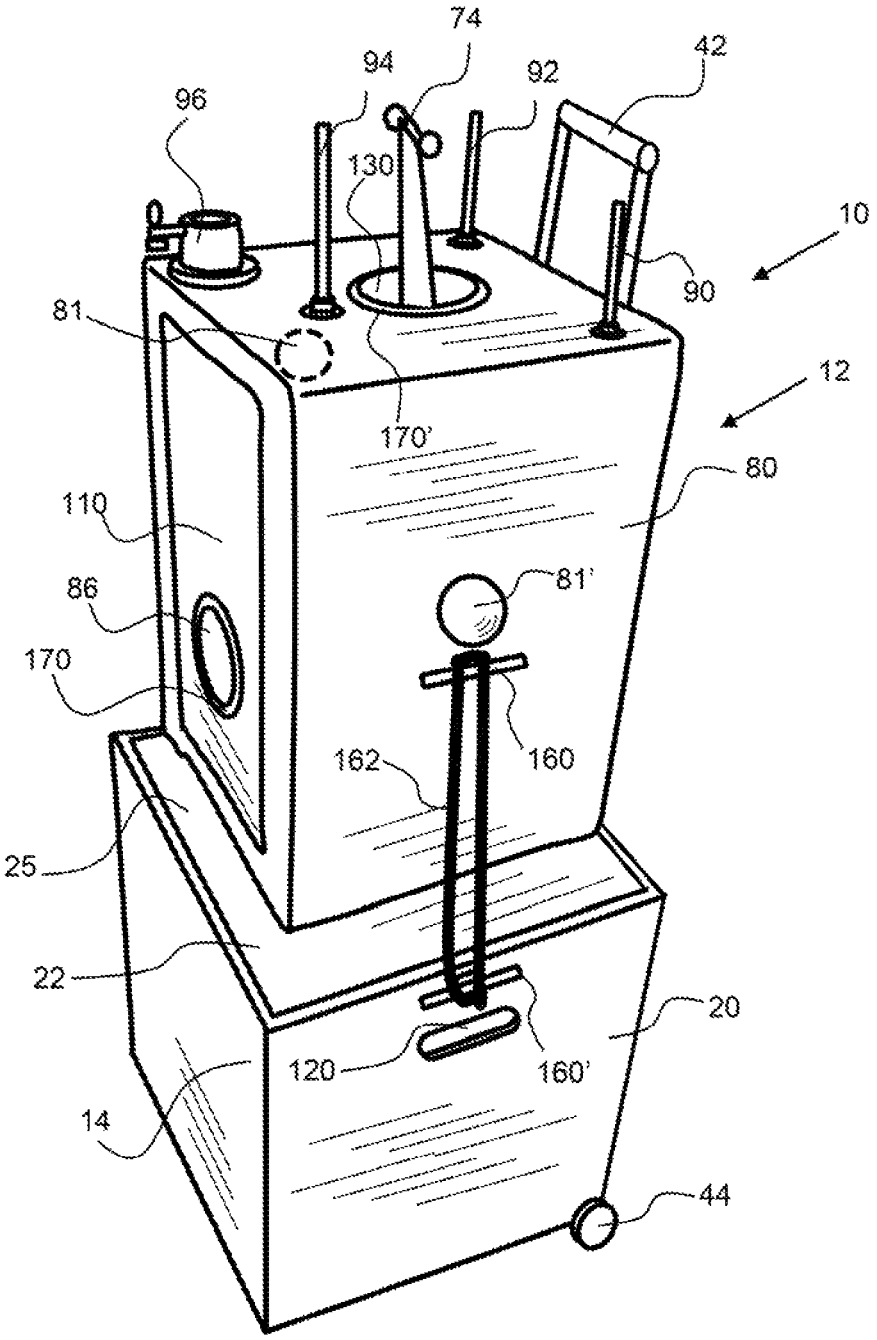
FIG. 2 shows an exemplary portable drum kit system in a transport configuration with the hi-hat stand stored in the top sound opening.

As shown in FIG. 2, the hi-hat stand 74 is retained in the top sound opening 130. When the cajon 80 is configured with a top sound opening, the sleeve 40 for the hi-hat stand, as shown in FIG. 1, may not be required. As shown in FIG. 2, a polymer panel 110 is configured along the front of the cajon. The polymer panel may produce a desired bass sound when it vibrates and it may be translucent or transparent to allow an audience to see through the panel and to see light effects from a light 81 configured in the interior of the cajon. As shown in FIGS. 1 and 2 a sonic enhancement port 170, 170' may be configured in the front sound opening 86 and top sound opening 130, respectively. Note that a cajon may be configured with only one of the sound openings shown, such as on the front of the cajon or on the top of the cajon.

Figure 3:
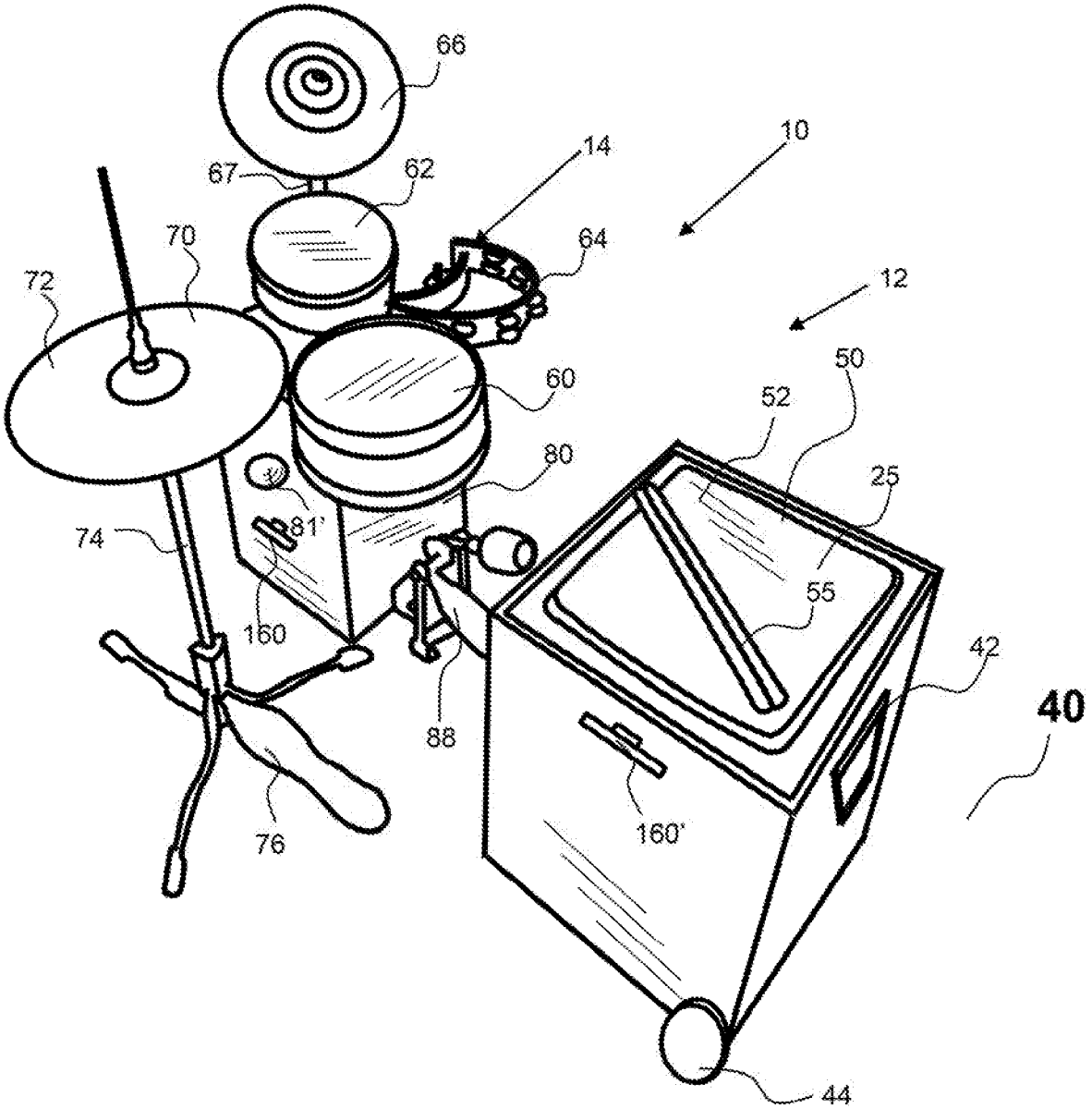
FIGS. 3 and 4 show an exemplary portable drum kit system in a drumming configuration comprising a convertible storage container with a seat, a plurality of drum components attached to the cajon and a hi-hat cymbal and stand.
Figure 4:
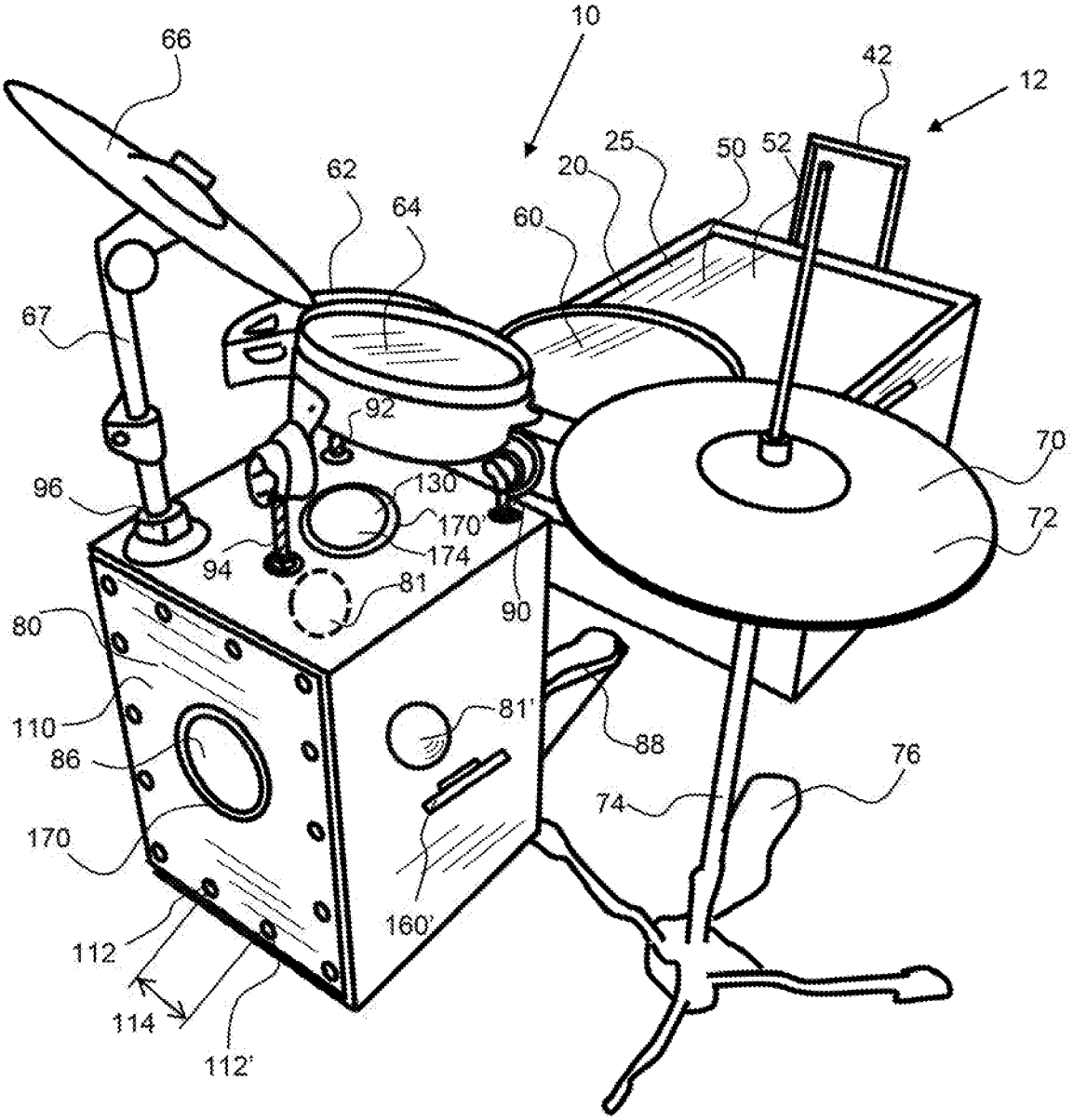

Referring now to FIGS. 3 and 4, an exemplary portable drum kit system 10 is configured in a drumming configuration with the plurality of drum components 14, removed from the convertible storage container 20 and attached to the attachments of the cajon 80. As best shown in FIG. 4, the snare drum 60 is attached to the snare drum attachment 90, the tom tom 64 is attached to the tom tom attachment 94, the tambourine 62 is attached to the tambourine attachment 92 and the cymbal 66 is attached to the cymbal attachment 96. The convertible storage container 20 is now converted to a seat, with the lid 25 flipped upside down to expose the seat 50 having a cushion 52. The cajon pedal 88 is attached to the cajon and a hi-hat 70 is set up to complete the exemplary portable drum set. The cajon 80 has a sound opening 86 on the front of the cajon through a polymer panel 110. The polymer panel 110 on the front of the cajon is secured by fasteners 112 having a fastener gap 114, or distance between the fasteners. A sound opening cover 174 is configured in the top sound opening 130 on the top of the cajon. The hi-hat comprises two hi-hat cymbals 72, a stand 74 and hi-hat pedal 76. As shown in FIG. 4, the cajon is configured with a top sound opening 130; not visible in FIG. 3. Sonic enhancement ports 170, 170' are configured in the sound openings 86, 130, respectively.

Figure 5:
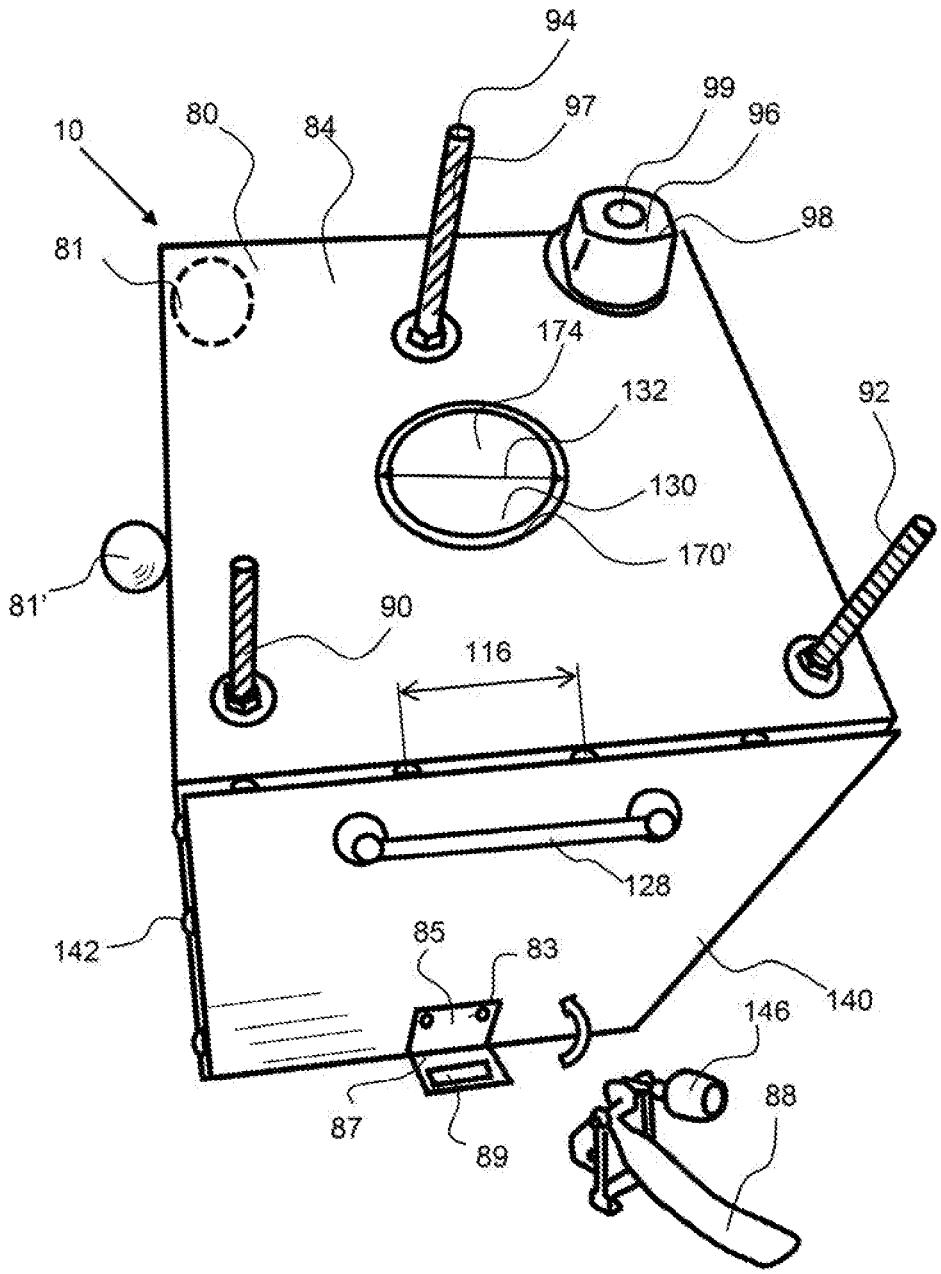
FIG. 5 shows a perspective view of an exemplary cajon having a plurality of attachments for drum components, a top sound opening and a batter panel that is offset a spacer gap distance by spacers.

As shown in FIG. 5, the top 84 of the cajon 80 has a plurality of attachments, such as a bolt type attachment 97 or a receiver attachment 98, comprising an opening 99 to receive a stand for a drum component. A top sound opening 130 is also configured in the top 84 of the cajon and has a diameter 132 that may be between 75 mm to 125 mm (3" to 5"). A drum component or stand component thereof may be detachably attached to the attachment and positioned according a drummer's preference. In an exemplary embodiment, the attachments include a snare drum attachment 90, a tambourine attachment 92, a tom tom attachment 94 and a cymbal attachment 96. As shown in FIG. 5, a cajon pedal bracket 83 is attached to the outside of the back wall of the cajon. The exemplary cajon pedal bracket comprises a cajon portion 85 and a pedal portion 87 and may be configured as a hinge that can rotate closed during transport and rotate open, as shown, for attachment of the cajon pedal 88. An exemplary cajon pedal bracket 83 may comprise a magnet 89 to secure the bracket in a closed position during transport. A cajon handle 128 is configured on the back side of the cajon. Also, a batter panel 140 is offset a batter spacer gap distance by spacers 142 configured between the batter panel and the cajon. This spacer gap enables the batter panel to vibrate more freely and produce more bass sound when impacted by the batter 146. The spacers may be configured with the batter fasteners 147 that secure the batter panel 140 to the cajon 80 and the batter fastener gap distance 116, or distance between the adjacent fasteners is shown and may be about 10 cm or more, about 12 cm, about 15 cm or more, about 20 cm or less, about 25 cm or less and any range between and including the fastener gaps provided.

Figure 6:
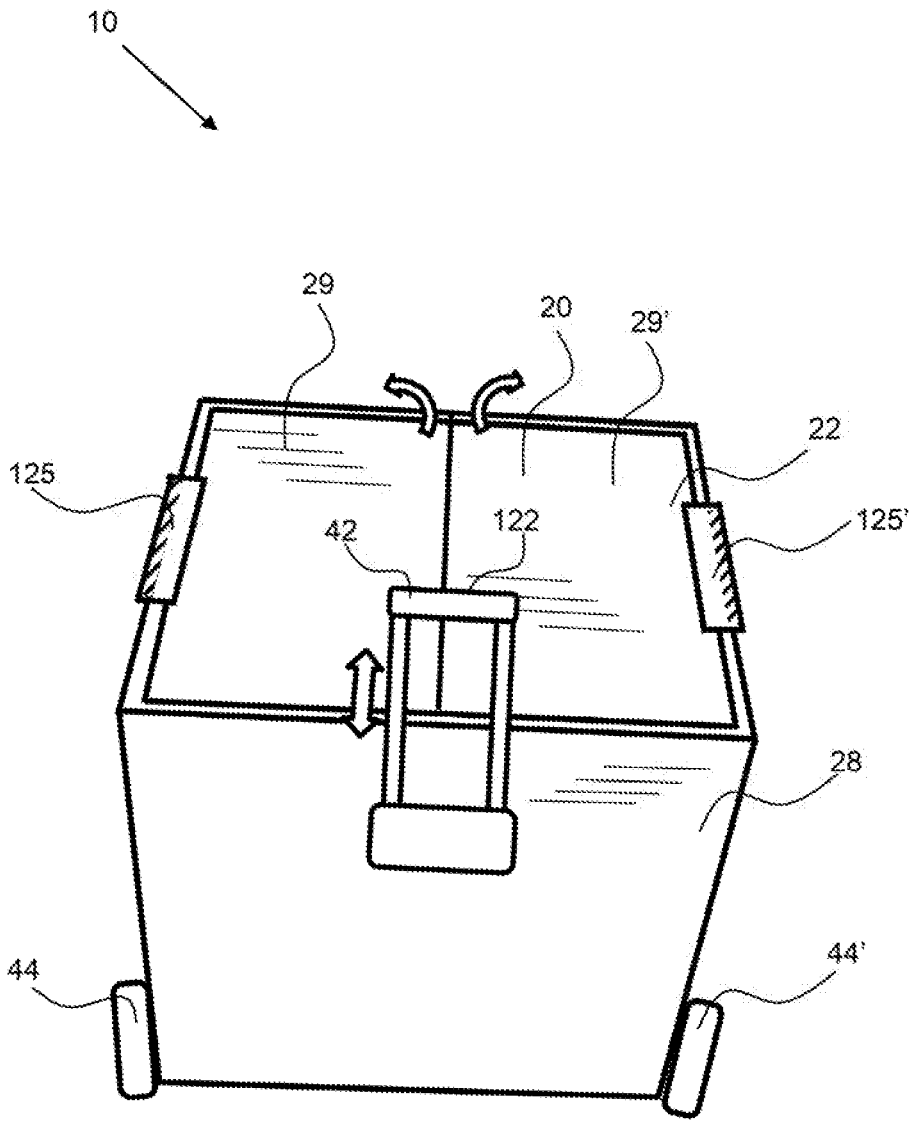
FIG. 6 shows a perspective view of an exemplary convertible storage container having wheels, a retractable handle and two top lid doors to provide access into the convertible storage container.

As shown in FIG. 6, an exemplary convertible storage container 20 has wheels 44 configured on the sides and configured up from the floor or base of the convertible storage container when sitting on a surface. The wheels will only engage the ground when the convertible storage container is tilted by the handle 42 back, or towards the back side 28. The exemplary lid 25 of the convertible storage container comprises lid doors 29, 29' that are coupled to the convertible storage container 20 by hinges 125, 125'. Also, the two lid doors 29, 29' are configured to swing open to allow access to the interior of the convertible storage container and hinges 125, 125' enable the opening of the lid doors. A retractable handle 122 is configured on the back of the convertible storage container 20 wherein the handle extends up and down from a bracket attached to the convertible storage container 20.

Figure 7:
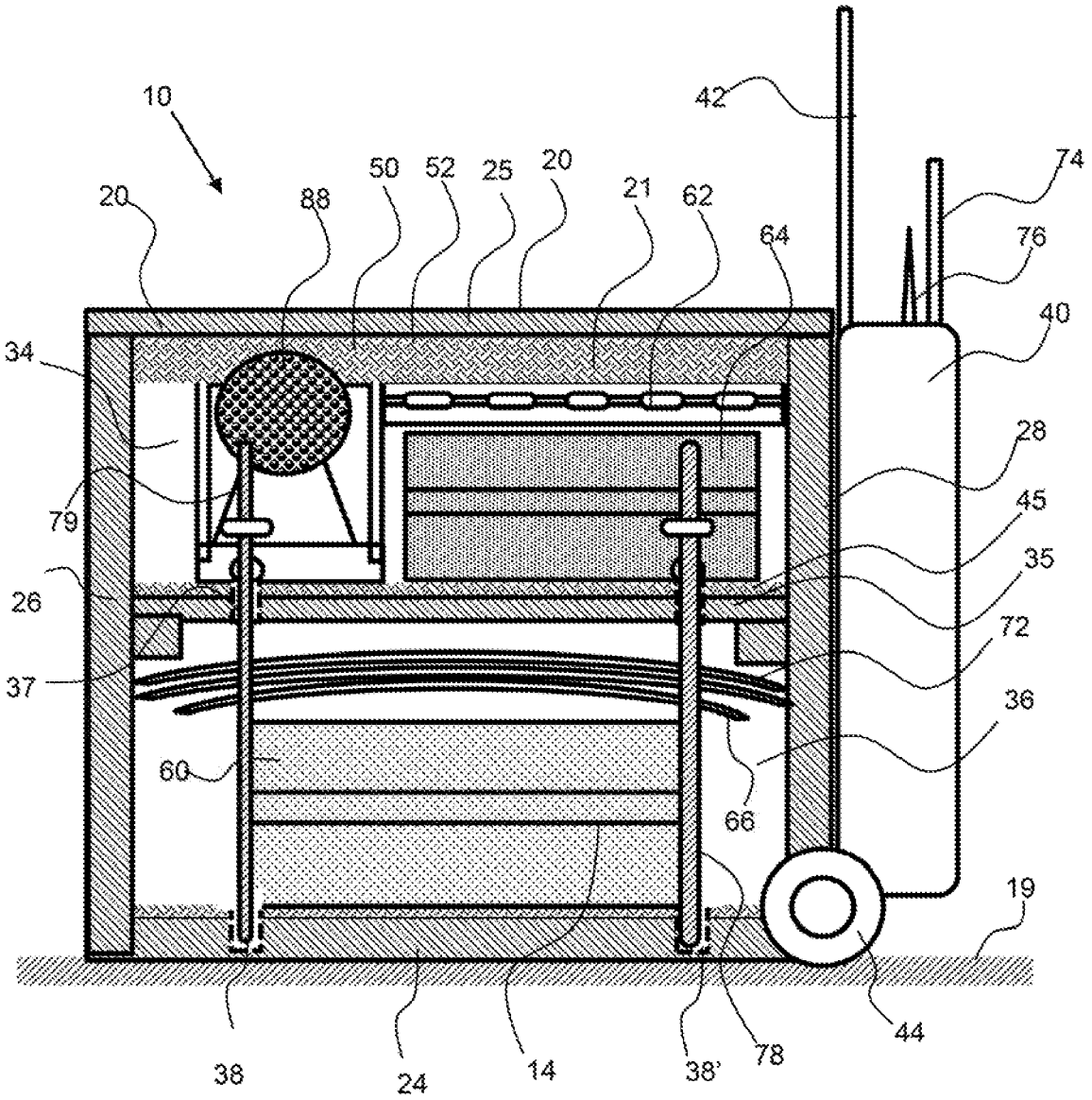
FIG. 7 shows a cross-sectional view of an exemplary convertible storage container with exemplary drum components configured therein.

As shown in FIG. 7, an exemplary convertible storage container 20 has a plurality of drum components 14 configured therein. In an exemplary embodiment, a snare drum 60, cymbal 66 and hi-hat cymbals 72 are configured in a lower portion 36 of the convertible storage container, a divider 35 divides the lower portion from an upper portion 34. The divider 35 may have a non-slip material 45 on the top surface to prevent drum components retained thereon from sliding. A non-slip material may be carpet, an elastomer material, foam and the like. In the upper portion, the tom tom 64, tambourine 62 and cajon pedal 88 are retained. The hi-hat rod 78 and cymbal rod 79 are configured through apertures 37 in the divider and may be retained in recess 38 in the base 24 of the convertible storage container. The lid 25 is configured with the seat 50 and seat cushion 52 facing into the interior of the container. The hi-hat stand 74 and hi-hat pedal 76 are retained in the sleeve 40. The wheels 44 are configured parallel with or above the ground level 19.

Figure 8:
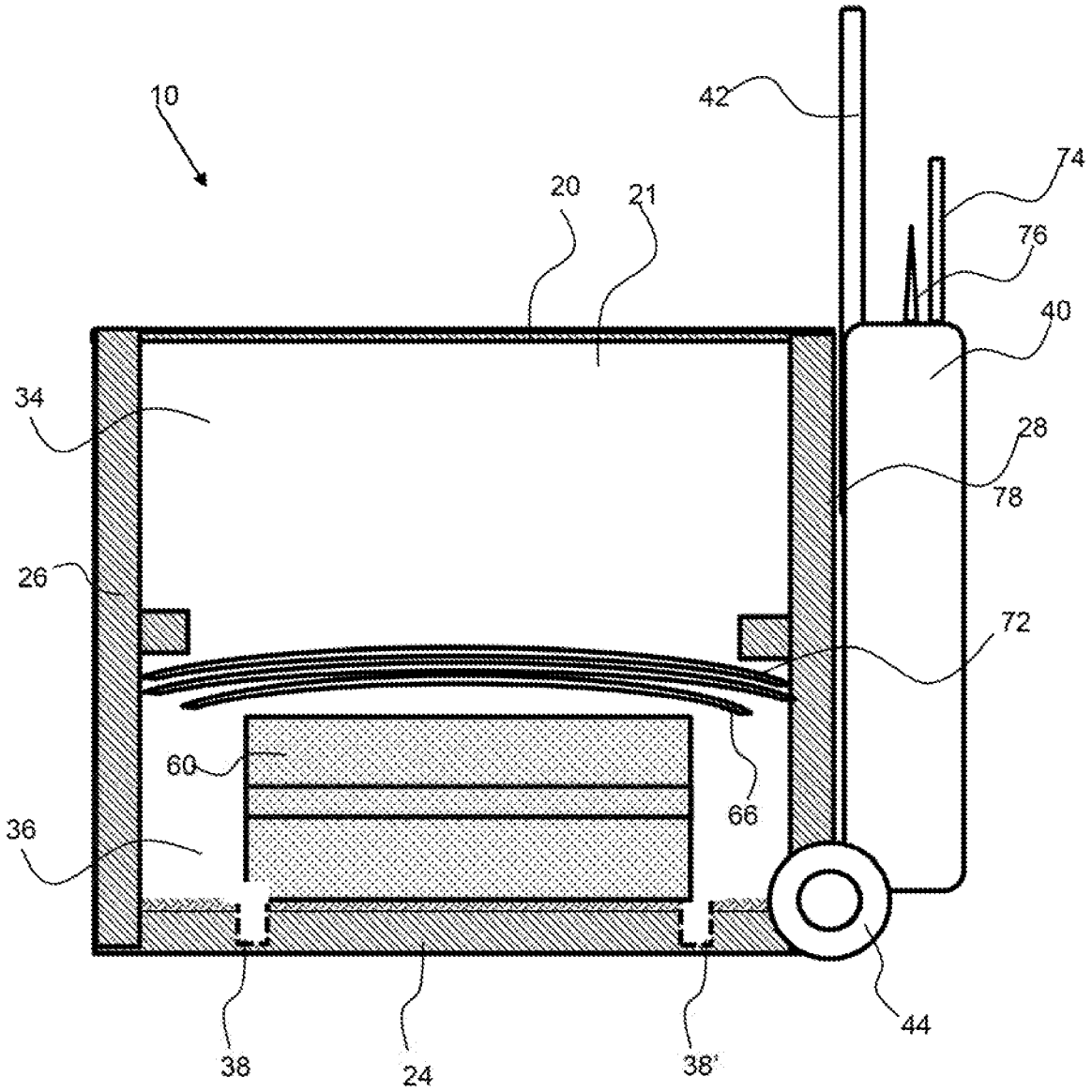
FIGS. 8 to 10 show cross-sectional views of an exemplary convertible storage container with exemplary drum components configured therein.

As shown in FIG. 8, the snare drum 60, cymbal 66 and hi-hat cymbals 72 are configured in the lower portion 36 of the exemplary convertible storage container 20. The snare drum and cymbals may be placed into the convertible storage container through the opening 21 in the container. The lid may be detachable. The hi-hat stand 74 and hi-hat pedal 76 are retained in the sleeve 40.

Figure 9:
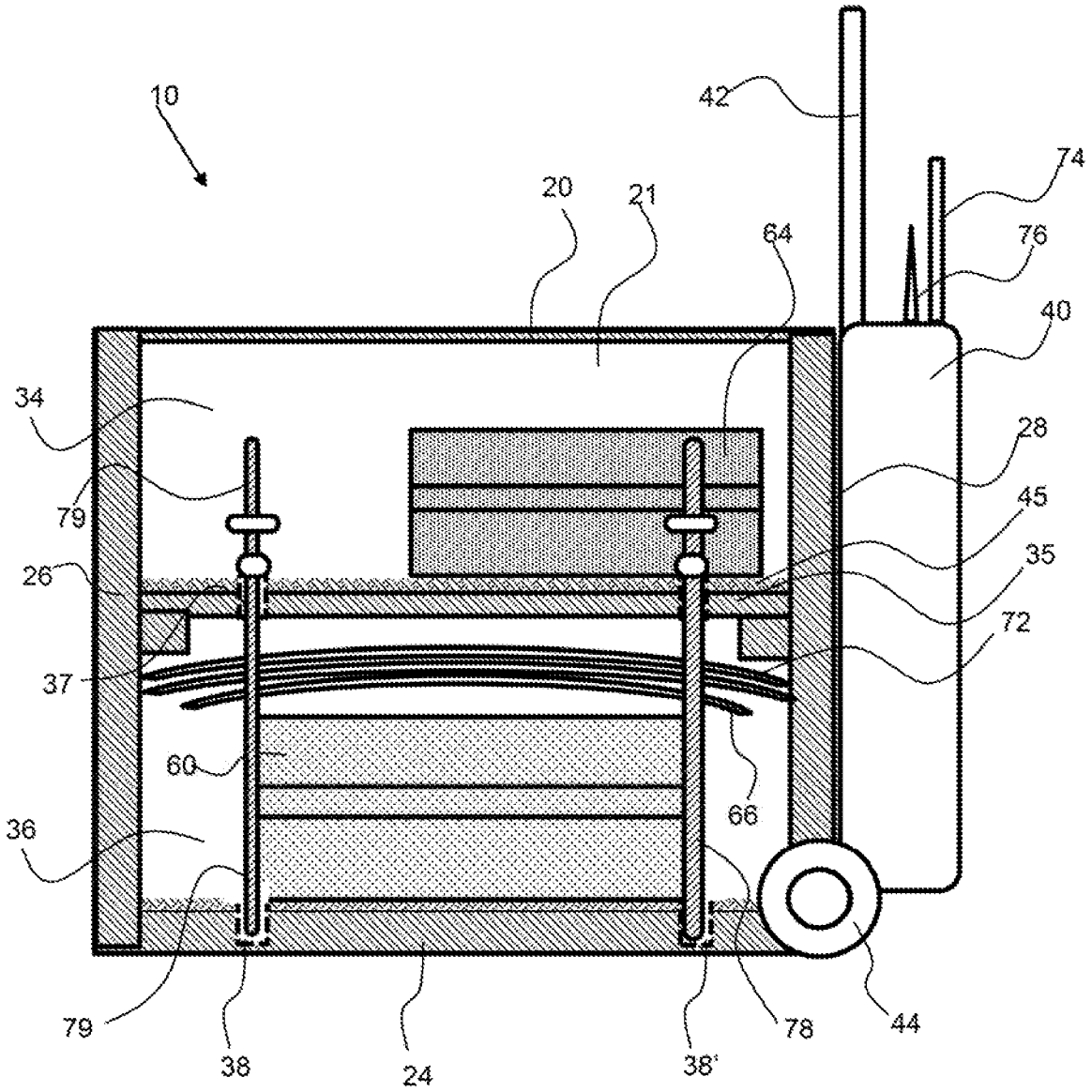
Figure 10:
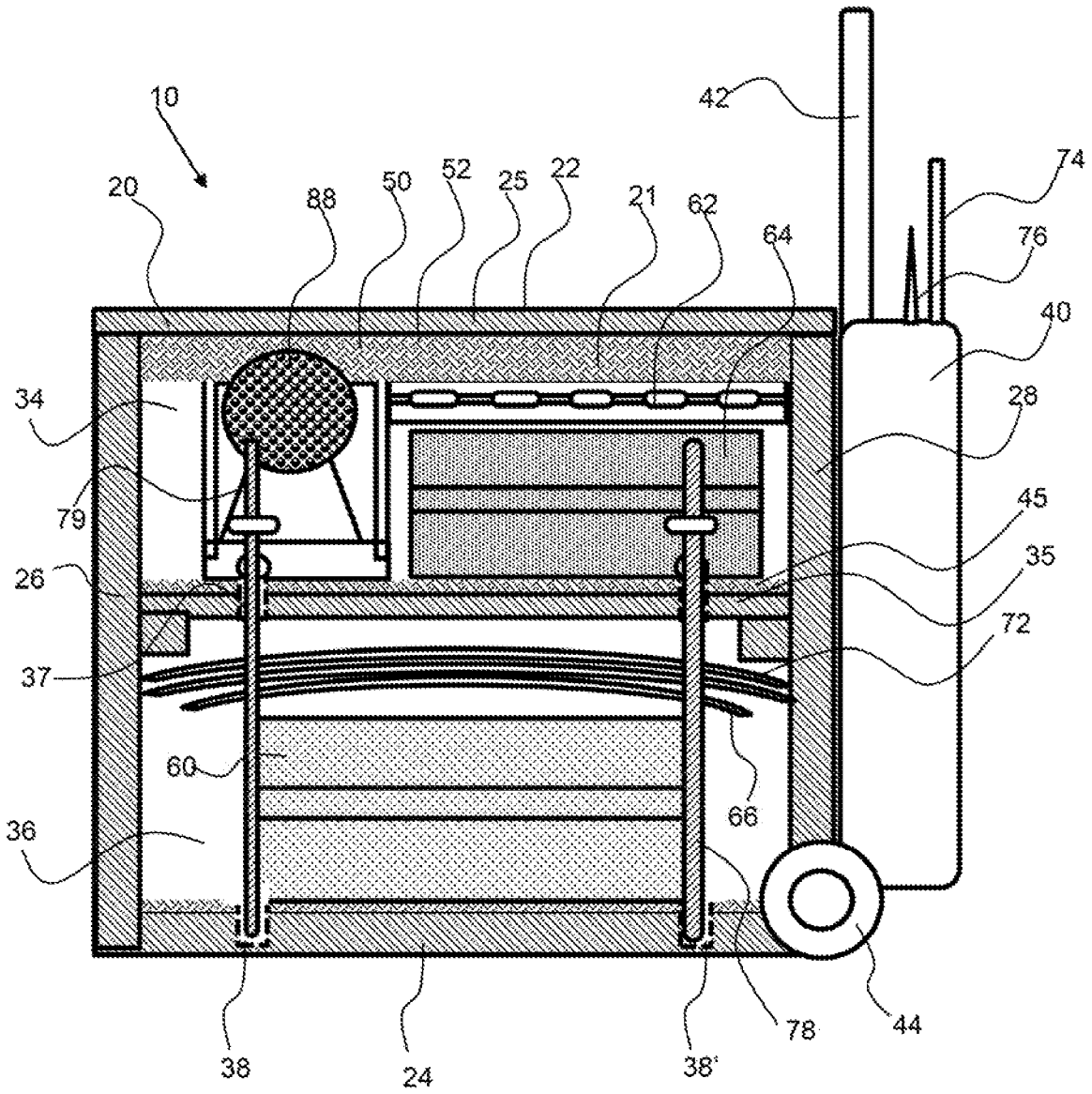

Referring now to FIGS. 9 and 10, the divider 35 is configured between the lower portion 36 and upper portion 34. The divider has apertures 37 to allow the cymbal stand rods 78, 79 to extend through the apertures and down into recess 38 in the base 24 of the convertible storage container. The divider may comprise a non-slip material 45 to prevent components from sliding during transport. As shown in FIG. 9, the tom tom drum 64 is configured in the upper portion 34 and is placed on the non-slip material 45 of the divider 35. As shown in FIG. 10, the cajon pedal 88, tom tom 64 and tambourine 62 are retained in the upper portion 34. The lid is configured with the seat cushion 52 facing inward which may be deformable and may also retain the components therein through compression of the seat cushion.

The cymbals are configured on top of the snare drum and have an interference fit with the interior sides of the exemplary convertible storage container to prevent displacement during transport. The shows cross-sectional views of an exemplary convertible storage container with exemplary drum components configured therein.

Figure 11:
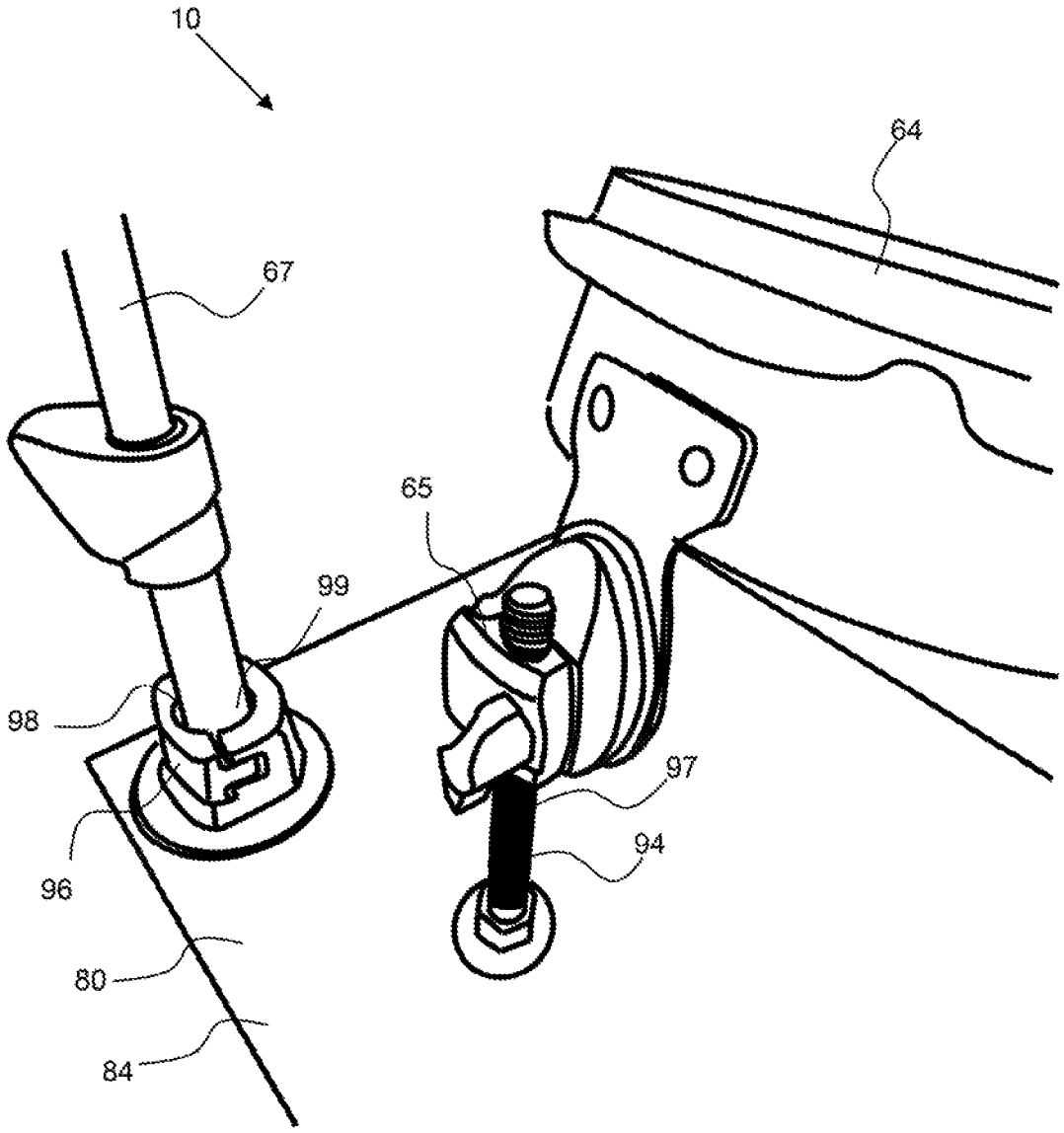
FIG. 11 shows an enlarged view of some of the attachments on the top of the cajon with the instruments attached thereto.

As shown in FIG. 11, the tom tom 64 is attached to the tom tom attachment 94 by an attachment bracket 65 that clamps around the bolt 97 and threads of the attachment 94. The cymbal stand 67 is attached to the cymbal attachment 96 by insertion into the opening 99 of the receiver 98 and then clamping of the receiver 98. Again, the drum components may also attach to the bolts with a drumkey.

Figure 12:
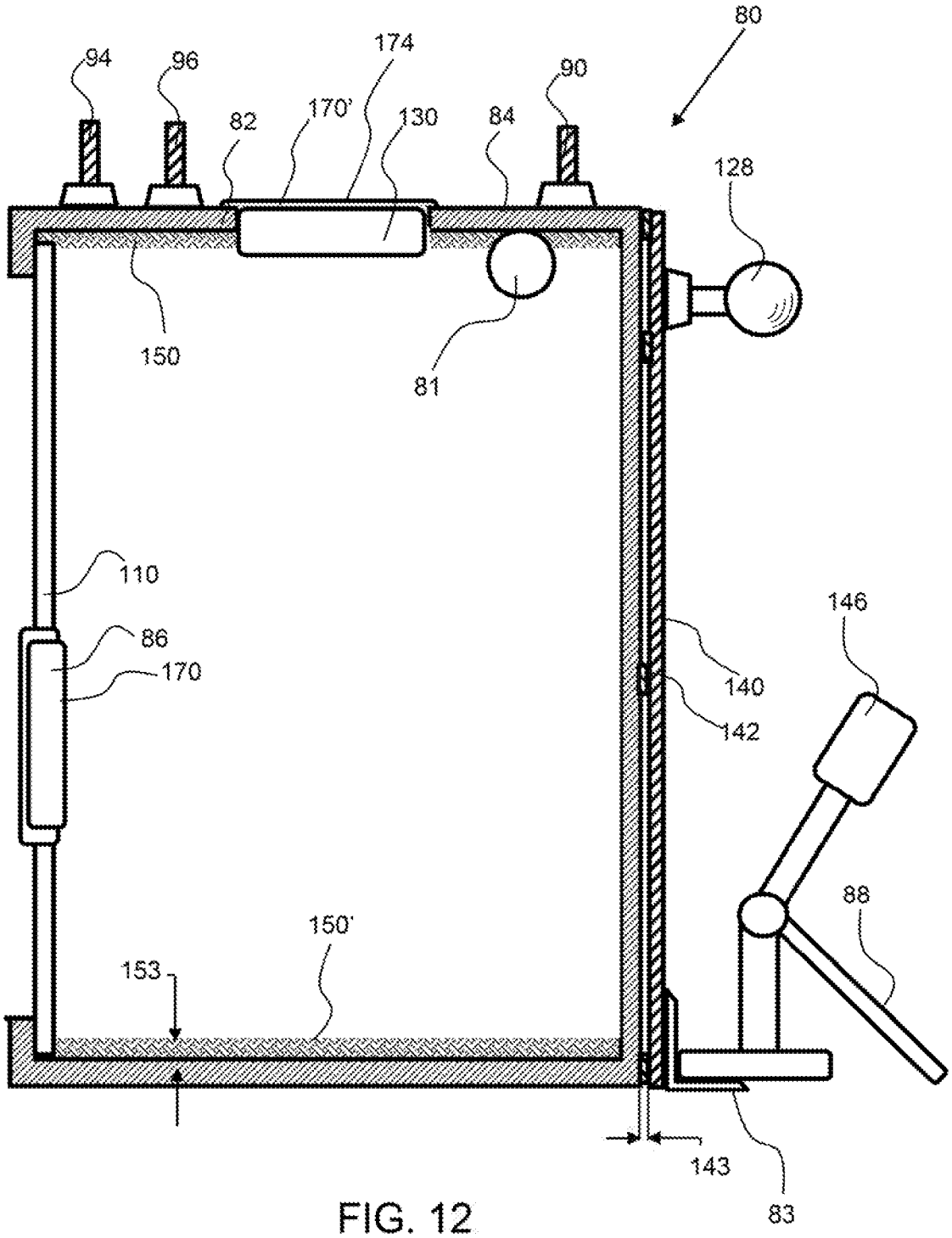
FIG. 12 shows a cross sectional view of an exemplary cajon having sound absorbing material on the interior, a top sound opening, a polymer panel on the front and a batter panel having a spacer gap to enhance vibration and sound.

As shown in FIG. 12, an exemplary cajon 80 has sound absorbing material 150 on the interior surfaces including along the top interior surface, the bottom interior surface and along the side interior surfaces, not shown. The sound absorbing material may also be configured along the back wall and along the front interior surface when a polymer panel 110 is not configured along the front of the cajon. The sound absorbing material may be configured to absorb higher frequency sounds thereby producing a deeper bass sound from the cajon. The sound absorbing material has a thickness 153 which may be effective to absorb mid range and higher frequencies. The sound opening 130 is configured in the top of the cajon which may enable the drummer to more easily hear the sound produced by the cajon. The front of the cajon is configured with a polymer panel, such as polycarbonate, which may be translucent or transparent to allow light to pass therethrough. A light 81 is configured inside, or in the interior of the cajon and may be configured to flash with the beat produced by the cajon. The light produced by the interior light passes through the translucent polymer panel to create a visually appealing effect. A batter panel 140 is configured along the back of the cajon and has a spacer gap 143 produced by the spacers 142. This spacer gap allows the batter panel to vibrate when impacted by the batter 146. This additional vibration produces a richer and deeper bass sound. A cajon handle 128 extends from the back side of the cajon. A sound opening 86 is configured in the front polymer panel 110 of the cajon 80 and a sonic enhancement port 170 is configured in the sound opening.

Figure 13:
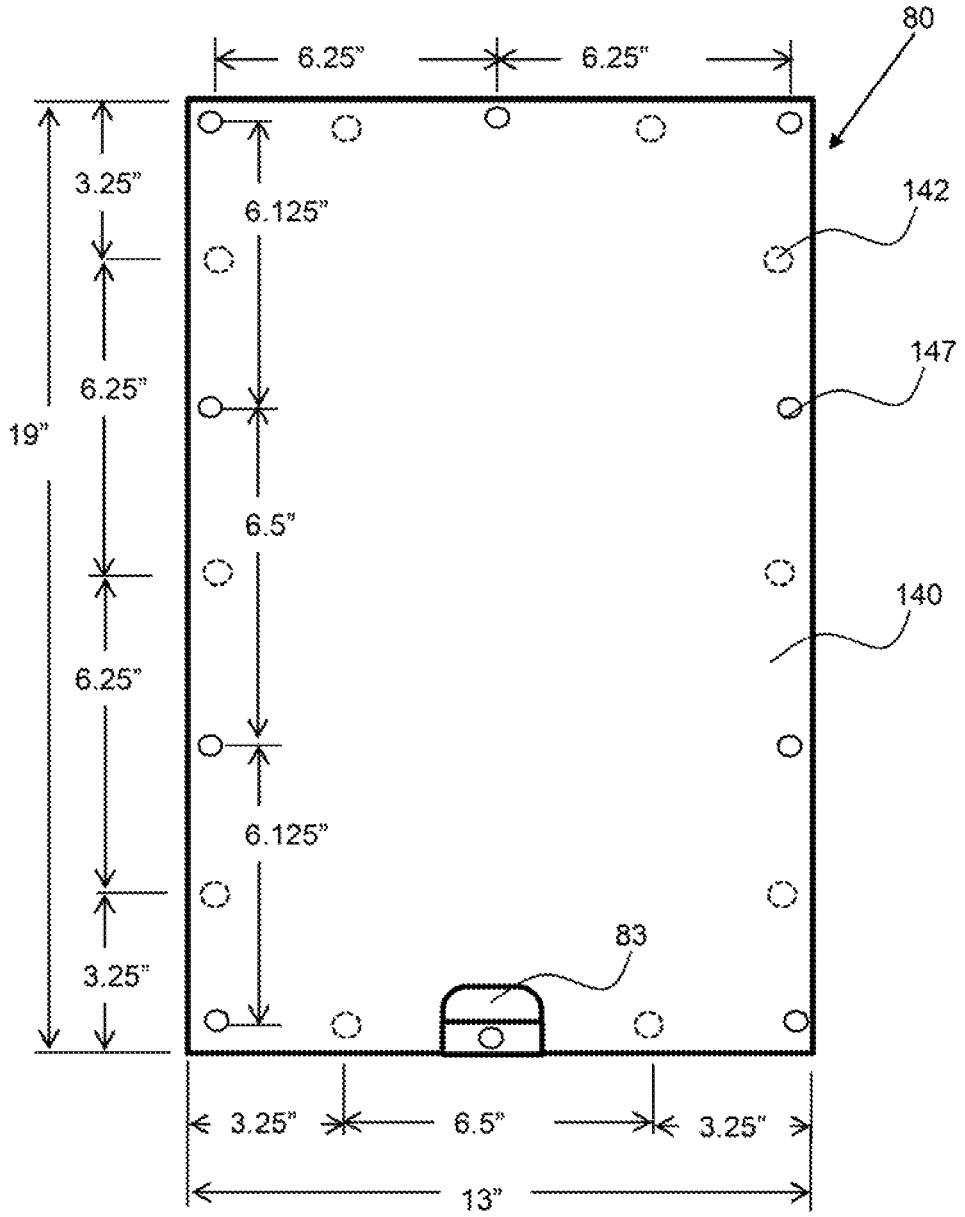
FIG. 13 shows a back view of an exemplary cajon having fasteners with spacers configured between the fasteners.

As shown in FIG. 13, an exemplary cajon 80 has a batter panel, such as a maple wood panel coupled to the cajon by batter fasteners 147 and spacers 142 are configured between the fasteners to allow the batter panel to vibrate to produce a richer sound. The batter panel in this exemplary embodiment is an ⅛ thick maple wood panel. The cajon pedal bracket 83 is shown along the bottom of the batter panel of the cajon.

Figure 14:
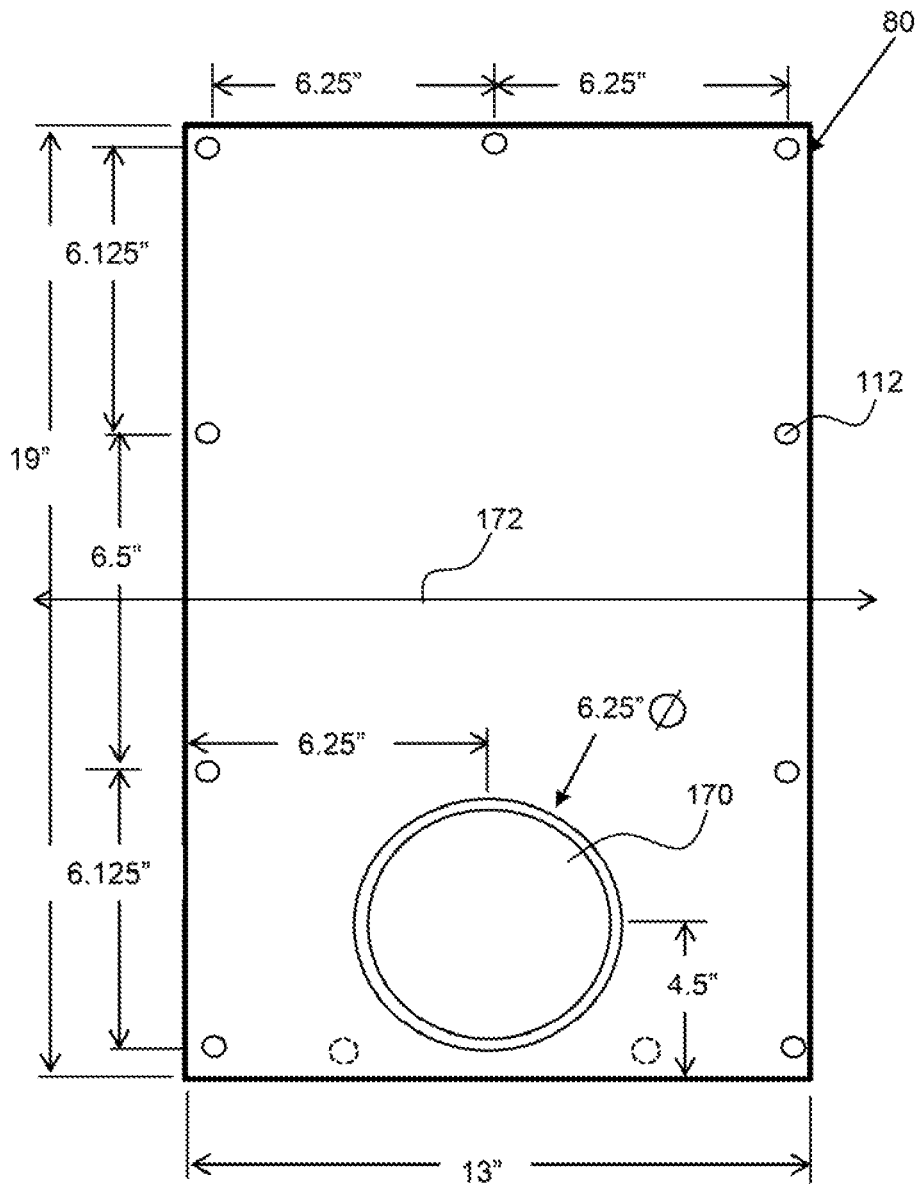
FIG. 14 shows a front view of an exemplary cajon having a sonic enhancement port configured in a polymer panel.

As shown in FIG. 14, an exemplary cajon 80 has sonic enhancement port 170 configured in a polymer panel, such as a 3/32 inch thick Poly(methyl methacrylate) (PMMA). The polymer panel is secured to the cajon with fasteners 112 having a fastener gap distance as shown. As described herein, the fastener gap distance may allow the polymer panel to vibrate and allow air to escape from between the fasteners. The sonic enhancement port is configured in the bottom half of the cajon, wherein the center of the sonic enhancement port is spaced 4.5" from the bottom of the cajon. As described herein the location of the sound opening in the front panel and sonic enhancement port may preferably be located with the bottom half of the cajon, wherein the center point is below center height 172 of the cajon and preferably wherein the entire sound opening or sonic enhancement port is below the center height of the cajon.

It will be apparent to those skilled in the art that various modifications, combinations and variations can be made in the present invention without departing from the scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A portable drum kit system comprising a portable drum kit comprising:

a) a convertible storage container that converts from a storage container to a seat, wherein the storage container comprises:
  i) a top opening;
  ii) a lower portion;
  iii) an upper portion;
  iv) a divider between the lower and upper portions comprising a plurality of apertures therethrough;
  v) a lid configured to cover said top opening of the convertible storage container;
  vi) a sleeve coupled to an exterior of the convertible storage container;

b) a plurality of drum components comprising:
  i) a snare drum;
  ii) a tambourine;
  iii) a tom tom;
  iv) a cymbal,
  v) a cajon comprising:
    a cajon pedal;
    an enclosure having a top;
    a sound opening;
    a plurality of drum component attachments comprising:
      a snare attachment extending from said top;
      a tambourine attachment extending from said top;
      a tom tom attachment extending from said top;
      a cymbal attachment extending from said top;
  wherein, in a transport configuration, the snare drum, cymbal and hi hat cymbals are configured in the lower portion of the convertible storage container;
  the cajon pedal, tambourine and tom tom are configured in the upper portion; and
  wherein, in a drumming configuration, the snare drum is detachable attached to the snare attachment;
  the tambourine is detachably attached to the tambourine attachment;
  the tom tom is detachably attached to the tom tom attachment;
  the cymbal is detachably attached to the cymbal attachment; and
  the convertible storage container is configured as a seat.

2. The portable drum kit system of claim 1, wherein a portion of the drum component attachments comprise a threaded bolt attachment.

3. The portable drum kit system of claim 1, wherein the tambourine attachment, the tom tom attachment and snare attachment comprise a threaded bolt attachment.

4. The portable drum kit system of claim 1, wherein the convertible storage container further comprises a pair of wheels configured to engage the ground when the portable storage container is tilted toward said pair of wheels.

5. The portable drum kit system of claim 4, further comprising a handle that is extends up from a top of the convertible storage container to enable the convertible storage container to be tilted toward the pair of wheels.

6. The portable drum kit system of claim 1, further comprising a hi-hat comprising:

a) two hi-hat cymbals;
b) a hi-hat pedal;
c) a hi-hat stand.

7. The portable drum kit system of claim 1, wherein the cajon comprises a polymer panel along a front of the cajon.

8. The portable drum kit system of claim 7, wherein the cajon pedal is detachably attachable to the cajon and wherein the cajon further comprises a cajon pedal bracket for attachment of the cajon pedal to the cajon.

9. The portable drum kit system of claim 7, wherein the sound opening is configured in the polymer panel, and wherein the cajon further comprises a sonic enhancement port in the sound opening.

* * * * *